US006361858B1

(12) United States Patent
Stedron et al.

(10) Patent No.: US 6,361,858 B1
(45) Date of Patent: Mar. 26, 2002

(54) MOUNTING FOR A COOKING SURFACE

(75) Inventors: Horst Stedron, Herborn; Bernd Schulteis, Schwabenheim, both of (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/355,607

(22) PCT Filed: Nov. 12, 1997

(86) PCT No.: PCT/EP97/06305

§ 371 Date: Jul. 30, 1999

§ 102(e) Date: Jul. 30, 1999

(87) PCT Pub. No.: WO98/34069

PCT Pub. Date: Aug. 6, 1998

(30) Foreign Application Priority Data

Jan. 31, 1997 (DE) ..... 197 03 543

(51) Int. Cl.[7] ..... B32B 27/20; B32B 27/36; B32B 27/38; B32B 27/42; F24C 15/30

(52) U.S. Cl. ..... 428/325; 524/434; 524/436; 524/437; 524/492; 524/493; 524/494; 277/637; 277/641; 277/642; 277/650; 277/651; 126/211; 126/217; 219/443.1; 219/451.1; 219/452.11; 219/452.12; 219/461.1; 219/467.1

(58) Field of Search ..... 525/111, 132, 525/168, 181; 524/434, 436, 437, 492, 493, 494; 428/325; 277/637, 641, 642, 650, 651; 219/443.1, 450.1, 451.1, 452.11, 452.12, 460.1, 461.1, 465.1, 467.1, 468.1; 126/211, 217

(56) References Cited

U.S. PATENT DOCUMENTS

| | | | | | |
|---|---|---|---|---|---|
| 4,100,211 | A | * | 7/1978 | Passalenti et al. | 260/835 |
| 4,211,686 | A | * | 7/1980 | Nishikawa et al. | 260/40 R |
| 4,465,806 | A | * | 8/1984 | Lee | 525/31 |
| 4,829,158 | A | * | 5/1989 | Burnham | 219/400 |
| 5,182,335 | A | * | 1/1993 | De Ra | 525/30 |
| 5,196,457 | A | * | 3/1993 | Wilkinson et al. | 522/103 |
| 5,269,217 | A | * | 12/1993 | Goad | 99/483 |
| 5,350,814 | A | * | 9/1994 | McGarry et al. | 525/531 |
| 5,380,799 | A | * | 1/1995 | Wiseman et al. | 525/111 |

FOREIGN PATENT DOCUMENTS

| | | |
|---|---|---|
| DE | 195 21 690 A1 | 12/1996 |
| EP | 0 449 347 B1 | 12/1995 |
| JP | 06-164175 | 6/1994 |
| JP | 6-164175 | 6/1994 |

OTHER PUBLICATIONS

Whelan, Tony, Polymer Technology Dictionary, p. 444, Jan. 1994.*

* cited by examiner

*Primary Examiner*—Vivian Chen
(74) *Attorney, Agent, or Firm*—Pauley Petersen Kime & Erickson

(57) ABSTRACT

A mounting for a cooking surface held at its periphery by at least one support part comprising a fiberglass reinforced duromer or thermosetting resin selected from the group consisting of an unsaturated polyester resin, a melamine resin, a phenol resin, and an epoxy resin, wherein the fiberglass reinforcement are glass fibers having a length of 15 mm to 65 mm.

3 Claims, No Drawings

MOUNTING FOR A COOKING SURFACE

BACKGROUND OF THE INVENTION

1. Field of the Invention

This invention relates to a mounting for a cooking surface, which is supported on its circumference by at least one support element made of a plastic material.

Such mountings are employed for fixing a cooking surface made of glass ceramic, for example, in an opening of a work plate.

2. Description of Prior Art

Conventional mountings are known from German Patent Reference DE 195 21 690 A1. Here, a frame made of a thermoplastic material is applied by injection molding to the circumference of the cooking surface. But the thermoplastic material has one disadvantage that it is not sufficiently thermally stable. For example, if heated pots are placed on the mounting, damage occurs. For this reason the surface of the mounting is covered by a protective cover. This protective cover is heat resistant and therefore keeps the temperature peaks away from the actual mounting. A large production and assembly cost is required for producing such a mounting.

A further mounting for a cooking surface is described in European Patent Reference EP 0 449 347 B 1. This is also applied to the cooking surface by an injection molding process using a thermoplastic material. The same problems as found in the teachings of German Patent Reference DE 195 21 690 A1 result here. The mounting can lose its strength under the strong effects of heat, so that there is the danger that the cooking surface comes loose.

SUMMARY OF THE INVENTION

It is one object of this invention to produce a mounting of the type mentioned at the outset, which can be produced with small costs and which is sufficiently temperature-resistant.

This object is attained with a mounting comprising a fiberglass-reinforced duromer, which is temperature-resistant.

DESCRIPTION OF PREFERRED EMBODIMENTS

It is possible to achieve a great strength of the mounting, with a small structural size at the same time, in accordance with this invention using a fiberglass-reinforced duromer. Thus, the mounting can absorb large loads. In particular, such a mounting also dependably supports a cooking surface which is loaded with several full pots. Because such a temperature-resistant duromer is used, no additional measures for protecting the mounting are required. Thus, it is possible to realize a reduced production outlay. The cooking surface can be cemented or clamped into the mounting.

In a preferred embodiment of this invention the duromer is an unsaturated polyester, which can be worked by a molding process. Two processing variations are possible here, for example. In one, the unsaturated, fiberglass-reinforced polyesters in the form of plate-shaped blanks are placed into a mold and are there processed into the mounting in a single process step. With another processing variation the unsaturated fiberglass-reinforced polyesters are in the form of a tangle of fibers. This, too, can be molded in a mold to form the mounting. The two processes are also called in brief SMC: sheet molding compound, or BMC: bulk molding compound. In a further preferred embodiment, the fiber-reinforced polyester is injection molded around the cooking surface.

A melamine resin, a phenol resin or an epoxy resin can also be used to produce the mounting of this invention. Melamine resin can be reinforced by longfibered glass fibers or other inorganic or organic fibers. The fibers preferably are of a length of 15 mm to 65 mm.

The properties of the duromer can be modified by the use of fillers and additives. By admixing aluminum hydroxide, the mounting becomes fire resistant. Improved scratch resistance can be achieved by using quartz, the employment of an admixed thermoplastic material improves the quality of the surface, in particular the shine of the mounting. If calcium carbonate is used as a filler, the material costs can be considerably reduced.

What is claimed is:

1. A mounting for a cooking surface, the mounting comprising:

at least one support element, the mounting supported at a circumference by the at least one support element, the at least one support element at least partially made of a duromer;

the duromer being one of an unsaturated polyester worked with one of a molding process and an injection molding process, a melamine resin, a phenol resin and an epoxy resin; and the duromer being fiberglass-reinforced; and wherein the duromer is reinforced with long-fibered glass fibers 15 mm to 65 mm long.

2. In the mounting in accordance with claim 1, wherein the cooking surface is one of cemented and clamped into the support element.

3. In the mounting in accordance with claim 1, wherein at least one filler of a calcium carbonate, an aluminum hydroxide, a quartz and a thermoplastic material is admixed to the duromer.

* * * * *